US005077945A

United States Patent [19]

Koeniger

[11] Patent Number: 5,077,945

[45] Date of Patent: Jan. 7, 1992

[54] DOORWAY FLOOD BARRIER

[76] Inventor: Erich A. Koeniger, 5600 Bridget Street, Metairie, La. 70003

[21] Appl. No.: 593,973

[22] Filed: Oct. 9, 1990

[51] Int. Cl.[5] ..... E06B 7/00

[52] U.S. Cl. ..... 52/169.14; 49/466; 49/463

[58] Field of Search ..... 52/2 B, 169.14, 202, 52/204, 63; 49/463-466; 405/104, 107

[56] References Cited

U.S. PATENT DOCUMENTS 3,796,010 3/1974 Carlson ..... 49/465 X
3,861,081 1/1975 Maskell ..... 405/104 X
3,975,870 8/1976 Naka ..... 49/463 X
4,375,929 3/1983 Clark ..... 52/169.14 X

FOREIGN PATENT DOCUMENTS 561250 10/1932 Fed. Rep. of Germany ..... 52/2.14

*Primary Examiner*—Richard E. Chilcot, Jr.
*Assistant Examiner*—Wynn Wood
*Attorney, Agent, or Firm*—Staas & Halsey

[57] ABSTRACT

A doorway mounted flood barrier including a barrier wall having two opposite vertical side edges and a horizontal bottom edge, and retainer means disposed between the barrier wall and a lower portion of the doorway for holding the barrier wall sealingly in the lower portion of the doorway.

3 Claims, 1 Drawing Sheet

DOORWAY FLOOD BARRIER

BACKGROUND OF THE INVENTION

1. Field of the Invention

The present invention relates generally to flood damage control and, more specifically, to a doorway mounted flood barrier.

2. Description of the Related Art

Flooding is a common problem in low lying areas. When flooding occurs, extensive damage to homes and businesses occurs when flood water enters doorways between the door frame and the door itself. This is because doors are not designed as water barriers. Typically, water seeps through the periphery of the door between the door itself and the door frame. Most flooding situations involve rising water which does not exceed more than a couple of inches to a couple of feet; however, any entrance of water into the house or business will result in substantial property damage.

SUMMARY OF THE INVENTION

An object of the present invention is to provide a doorway mounted flood barrier which is capable of preventing water from seeping between the door and the door frame.

Another object of the present invention is to provide a doorway mounted flood barrier which can be placed in a doorway quickly and easily.

Another object of the present invention is to provide a doorway mounted flood barrier which is relatively simple in construction and cost effective to produce.

These and other objects of the invention are met by providing a doorway mounted flood barrier which includes a barrier wall having two opposite vertical side edges and a horizontal bottom edge, and retainer means disposed between the barrier wall and the doorway for holding the barrier wall sealingly in a lower portion of the doorway.

These and other objects and features of the invention will become more apparent with reference to the following detailed description and drawings.

The seal segments can be attached to the peripheral edges of the barrier wall 18 by any conventional means. In the illustrated embodiment, the peripheral edges are formed as rims with curled ends which grip a base portion 18*a* of the seal segments.

DETAILED DESCRIPTION OF THE PREFERRED EMBODIMENT

Figure 1:
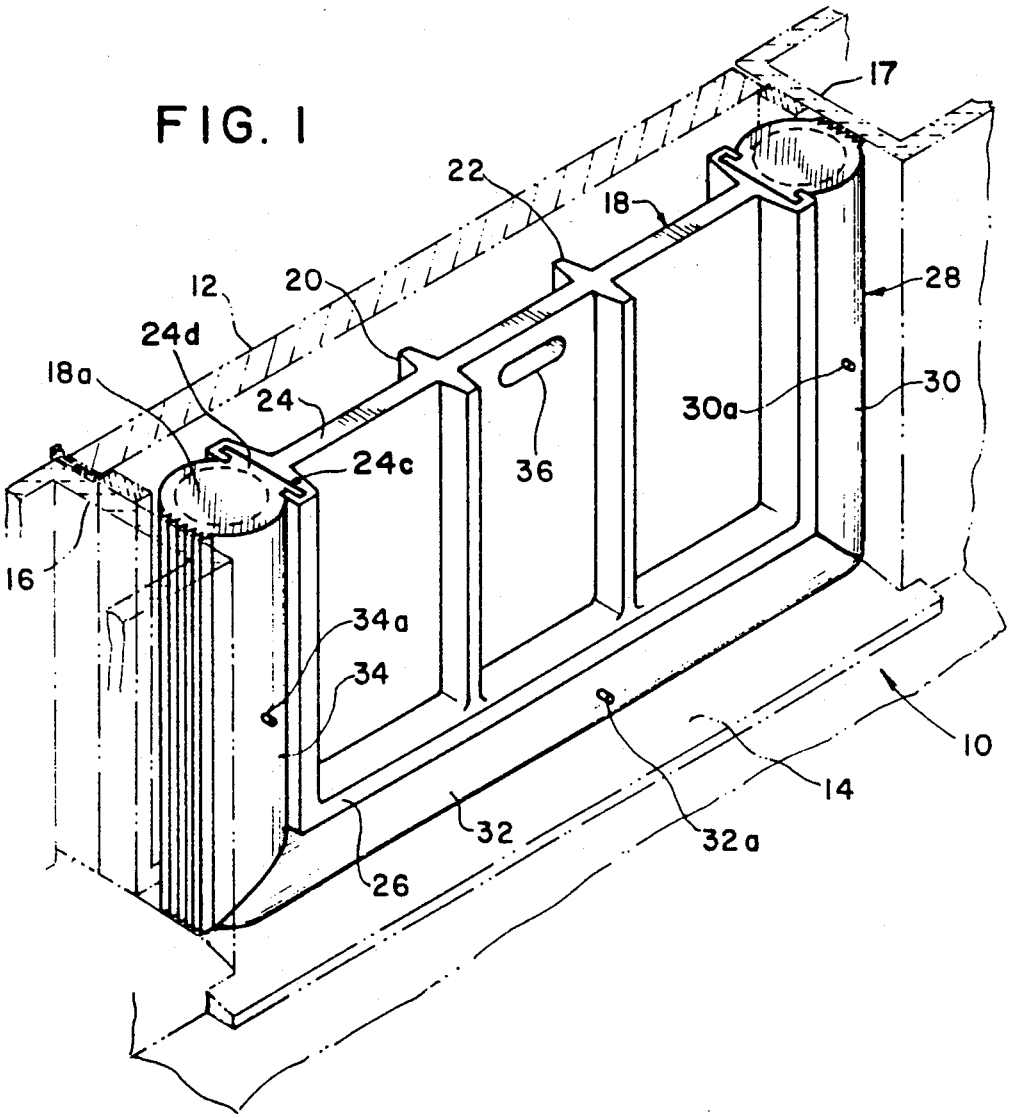
FIG. 1 is a perspective view of a preferred embodiment of the present invention.

Referring now to FIG. 1, a doorway mounted flood barrier is generally referred to by the numeral 10 and is designed to fit in a doorway on the outside of a door 12. The door closes in a door frame having a bottom 14 and opposite sides 16 and 17. To the word "doorway" refers to an opening in which a door is mounted. This usually involves a door frame as illustrated.

In a flooding situation, water normally enters the house by seeping between the peripheral edges of the door 12 and the doorway, particularly at the lower one to six inches of the doorway. In other words, most flooding occurs when water one to six inches deep rises on the door 12 and seepage occurs at the bottom of the door and at the sides contiguous with the bottom.

According to the present invention, a doorway mounted flood barrier 10 is mounted in the doorway in front of the door 12 so as to provide a sealed barrier to flood water. The barrier 10 includes a barrier wall 18 which is preferably integrally formed of cast aluminum. As a means of providing strength and reduced weight, the barrier wall 18 can be formed with longitudinally disposed stiffening ribs 20 and 22 which extend from the top 24 to the bottom 26 of the barrier wall.

The barrier wall 18 has a height sufficient to block most flooding situations and is preferably only about one to two feet in total height. The width is selected to stand the doorway horizontally and thus the barrier can be cast to fit standard door dimensions.

The peripheral edges of the barrier wall 18 are provided with an inflatable seal, collectively referred to by the numeral 28 and being composed of three contiguous segments 30, 32, and 34. In a preferred embodiment, the contiguous segments 30, 32 and 34 are separately inflatable through valve stems 30*a*, 32*a* and 34*a*. Inflation can be performed by using a standard bicycle tire pump, for example. Each seal segment has an integrally formed gripping member 36 formed medially on each segment so as to grip the corresponding doorway structure. Inflatable seals suitable for this purpose are commercially available from the SEAL MASTER Corporation of Kent, Ohio.

When flooding conditions are eminent, the barrier 10 is positioned in the doorway with the seals uninflated. A handle 36 can be formed in the barrier wall as a recess so as to aid lifting and placement of the barrier wall. Once positioned at a lower portion of the doorway, with the bottom of the barrier 10 resting on the bottom of the door frame, the two side segments of the seal are inflated so that a water tight barrier is created and held in place. Then, the bottom seal segment is inflated, the barrier wall is retained in its position by the enlargement of the seals due to their inflated condition.

In order to install the device according to the present invention, the device is placed in a doorway and the two side segments 30 and 34 are inflated through their separate inflation valves 30*a* and 34*a*. Once these are inflated, the panel is held in place so that the bottom segment 32 can then be inflated through the inflation valve 32*a*. This arrangement has advantages over a continuous inflatable seal because with a continuous inflatable seal (meaning only a single valve stem inflates a single U-shaped chamber), the bottom portion of the seal would tend not to properly inflate. The bottom is essential for maintaining a water-tight seal and thus, the device would fail without having separately inflatable segments. Moreover, with a continuous inflatable seal, the corners would be difficult to seal because of the creation of a radius, which would allow water to seep in at each corner. In the present invention, the two side segments 30 and 34 are adhesively bonded with epoxy to the bottom segment 32 to form substantially right-angled forms which snugly fit in the corners. Also, the barrier wall is provided with a slot 24*c* along the sides and bottom, and the seal segments are provided with a correspondingly shaped mounting portion 24*d* which tightly fits with the slot 24*c*. Also, adhesive, such as epoxy, is used to secure the segments at their mounted positions so that a water-tight seal is ensured.

Numerous modifications and adaptations of the present invention will be apparent to those so skilled in the art and thus, it is intended by the following claims to cover all such modifications and adaptations which fall within the true spirit and scope of the invention.

What is claimed is:

1. A doorway mounted flood barrier comprising:

a barrier wall detachably mounted in the doorway of a door and having two opposite vertical side edges and a horizontal bottom edge;

segmented retainer means disposed between the barrier wall and a lower portion of the doorway for holding the barrier wall sealingly in the lower portion of the doorway;

wherein the segmented retainer means includes a first seal segment sealingly disposed on the bottom edge, and second and third seal segments sealingly disposed on at least a lower portion of the two opposite side edges, respectively;

wherein the seal segments are inflatable through separate valves;

wherein the segmented inflatable seal segments are bonded to each other at two corners of the barrier wall so as to be straight and contiguous;

wherein the barrier wall includes a pair of vertical stiffening ribs; and wherein the inflatable seal segments includes a medially disposed gripping member for contacting the doorway.

2. A doorway mounted flood barrier according to claim 1, wherein the segmented retainer means are adhesively connected to the two opposite vertical side edges and the horizontal bottom edge of the barrier wall and have mounting portions received in mounting slots formed peripherally around the barrier wall.

3. A doorway mounted flood barrier according to claim 2, wherein the mounting slots and mounting portions are adhesively bonded.

* * * * *